US006889445B1

(12) United States Patent
Varona et al.

(10) Patent No.: US 6,889,445 B1
(45) Date of Patent: May 10, 2005

(54) MULTI-WATTAGE BLOW DRYER WITH USER INACCESSIBLE POWER SELECTOR

(75) Inventors: David Varona, West Palm Beach, FL (US); Memi Faustini, Fairfield, CT (US)

(73) Assignee: Sunbeam Products, Inc., Boca Raton, FL (US)

( * ) Notice: Subject to any disclaimer, the term of this patent is extended or adjusted under 35 U.S.C. 154(b) by 32 days.

(21) Appl. No.: 10/753,124

(22) Filed: Jan. 6, 2004

(51) Int. Cl.[7] ..... F26B 25/00
(52) U.S. Cl. ..... 34/97
(58) Field of Search ..... 34/90, 97, 98; 392/380–385

(56) References Cited

U.S. PATENT DOCUMENTS 4,135,080 A * 1/1979 Wells, Jr. ..... 392/385
4,195,416 A 4/1980 Hall
4,198,557 A 4/1980 Crowley
4,260,875 A 4/1981 Walter et al.
4,309,595 A 1/1982 Long et al.
4,420,679 A * 12/1983 Howe ..... 219/400
4,711,988 A * 12/1987 Thaler et al. ..... 392/379
4,735,002 A 4/1988 Rath
4,788,413 A 11/1988 Eng
4,904,847 A * 2/1990 Kosaka et al. ..... 392/384
4,972,065 A 11/1990 Ohlsen
6,280,211 B1 8/2001 Tateishi

FOREIGN PATENT DOCUMENTS

JP 2001121950 * 5/2001

* cited by examiner

*Primary Examiner*—Stephen Gravini
(74) *Attorney, Agent, or Firm*—Lawrence J. Shurupoff

(57) ABSTRACT

A hair dryer, includes a casing, an electric blower adapted to draw air into the casing from an intake port and blow the air out an exhaust port, one or more electric heating elements disposed to heat the air as it passes through the casing, a power selector switch having two or more wattage settings and adapted to adjust the electrical power supplied to the heating elements, and wherein the power selector switch is designed to be substantially inaccessible to the user.

9 Claims, 8 Drawing Sheets

MULTI-WATTAGE BLOW DRYER WITH USER INACCESSIBLE POWER SELECTOR

BACKGROUND OF THE DISCLOSURE

1. Field of the Disclosure

The present invention relates to blow dryers having hidden power controls that are designed to be relatively inaccessible to a user but accessible to an installer.

2. Description of Related Art

Generally, it is known in the art of blow dryers to provide multiple power settings. Typically, a blow dryer will have two or three settings to provide low medium or high heat settings. The change in a heat setting is achieved by providing increased or decreased wattage to the heating coils.

A power or wattage problem can arise in multiple unit dwellings, such as hotels wherein multiple high wattage appliances may be used at the same time. In the morning hours, many of the guests are simultaneously using the hotel-supplied blow dryers as they prepare for their day. They may also be using hotel-supplied coffee makers simultaneously. This results in a large power drain on the building's power system that can cause power outages in buildings with wiring that cannot handle the morning power surge.

SUMMARY OF THE DISCLOSURE

The present invention is directed to a hair dryer, including a casing, an electric blower adapted to draw air into the casing from an intake port and blow the air out an exhaust port, one or more electric heating elements disposed to heat the air as it passes through the casing, a power selector switch having two or more wattage settings and adapted to adjust the electrical power supplied to the heating elements. The power selector switch is preferably designed to be inaccessible to the user.

In another aspect of the hair dryer, the switching of the power selector switch requires a tool.

In another aspect of the hair dryer, the power selector switch is concealed from the user's view during normal operation of the hair dryer.

In another aspect of the hair dryer, the power selector switch is adapted to short out one or more of the heating elements.

In another aspect of the hair dryer, the power selector switch is adapted to divert current among the heating elements.

Another aspect of the hair dryer includes a user control allowing the user to adjust the power output of the heating elements up to a maximum determined by the setting of the power selector switch.

In another aspect of the hair dryer, the user control allows the user to divert alternating current through a diode.

Disclosed is a hair dryer including, a casing, an electric blower for drawing air into the casing from an intake port and blowing the air out an exhaust port, one or more electric heating elements for heating the air as it passes through the casing, a power selector switch having two or more wattage settings for adjusting the maximum electrical power supplied to the heating elements, and wherein the power selector s is inaccessible to the user.

Disclosed is a hair dryer having a casing, electric blower means for drawing air into the casing from an intake port and blowing the air out an exhaust port, one or more electric heating means for heating the air as it passes through the casing, user switching means having two or more wattage settings for adjusting the electrical power supplied to the heating elements, and a switch cover means for optionally limiting the wattage setting available to the user.

DETAILED DESCRIPTION OF PREFERRED EMBODIMENTS

Figure 1:
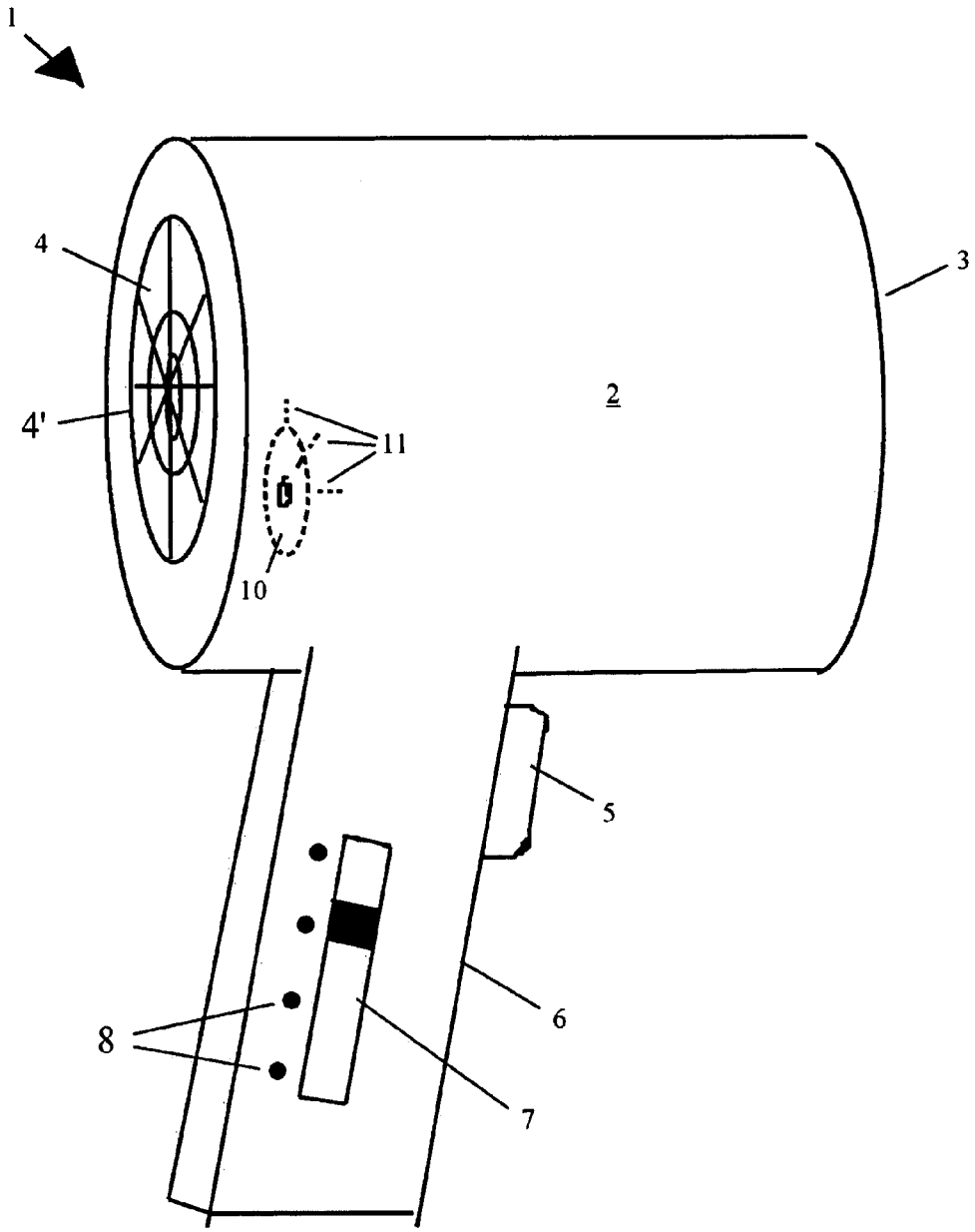
FIG. 1 is a schematic perspective view of an embodiment of the invention.

Referring to FIG. 1 there is shown a typical pistol-grip type hair blower or hair dryer 1 having a pistol-grip 6, a main body 2, an exhaust port 3 and an intake port 4 defined by an intake grate 4'. When the user activates a control 5, such as a trigger, a blower fan draws air through the intake port 4 and blows it over one or more heating elements and out through the exhaust 3.

Also provided is a power selector switch 10 having two or more power settings 11 that determine the maximum power consumption of the heating element(s). The power selector switch is concealed within the body 2 of the hair dryer 1 in a position that is designed to be inaccessible to the ordinary user of the device so as the render the power selector switch 10 unusable to the user.

Figure 2:
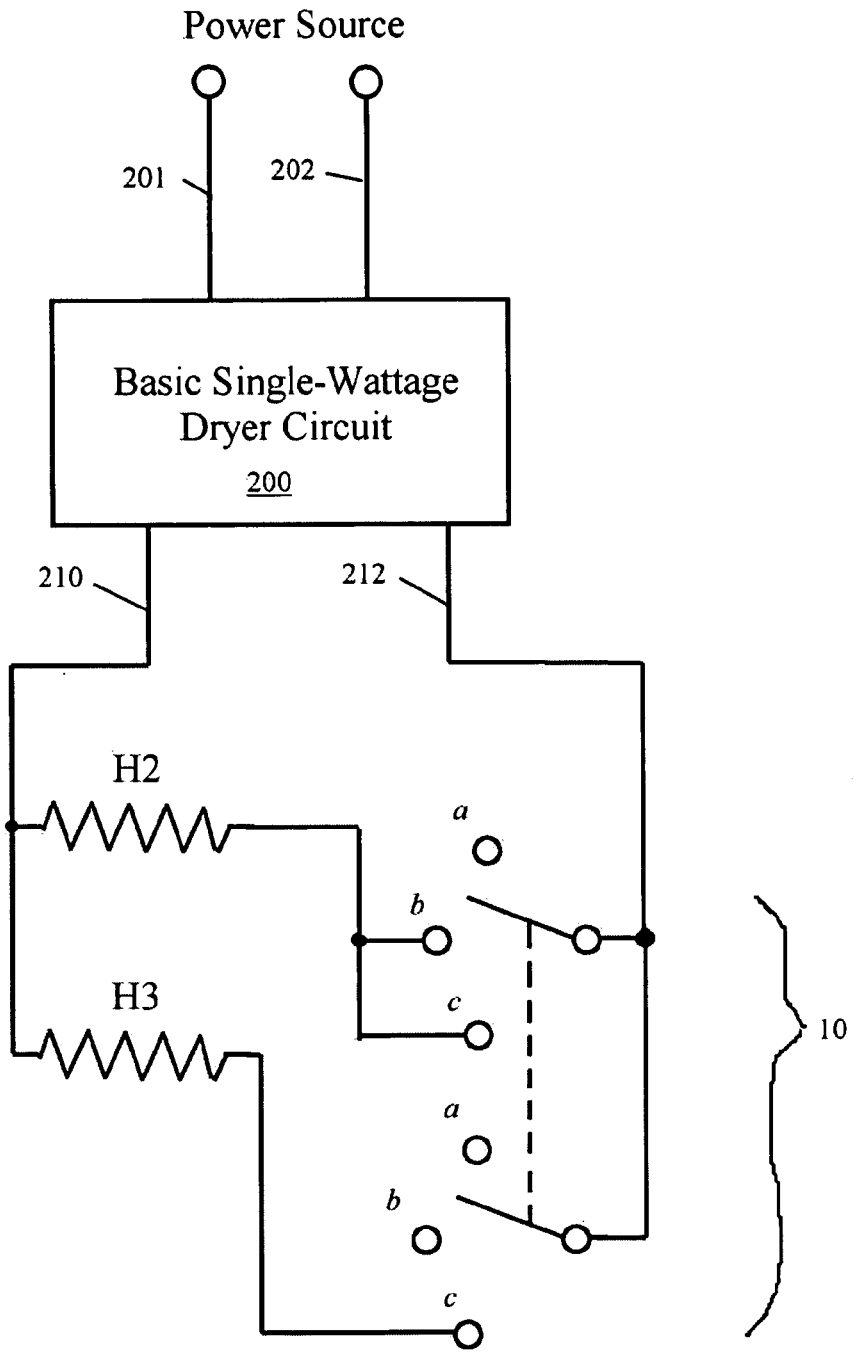
FIG. 2 is a circuit diagram of an embodiment of one circuit according to the invention.

Referring to FIG. 2, there is shown an embodiment of the circuitry of the blow dryer 1 having a set of power lines 201, 202 supplying power to a typical single-wattage dryer circuit 200 as is well known in the blow dryer art. Power extension lines 210 and 212 are provided to allow power to be delivered to one or more supplementary heating coils H2, H3. The primary heating coil H1 is located in the basic circuit 200, see FIG. 4. I*n* the embodiment of FIG. 2, additional power levels of heating are provided by turning on additional supplementary heating coils by the power selector switch 10, which in this case is symbolized by a double-pole, triple-throw switch. When this switch is in a first position a, heating elements H2, H3 are both off. In second position b, heating element H2 turns on. In third position c, heating elements H2, H3 are both on. Hence, additional watts of heating power are added incrementally.

In a typical design, the supplementary heating elements H2, H3 will consume much less power than that of the basic single-wattage dryer circuit, perhaps no more than 100 to 300 watts each, so that the power demands on the power selector switch 10 are not great, thereby reducing any chance of arcing. Typically, the lowest power setting for the blower 1, representing only H1 activated, will be about 800 to 1,100 watts, and the highest setting will be about 1,200 to 1,900 watts.

Figure 3:
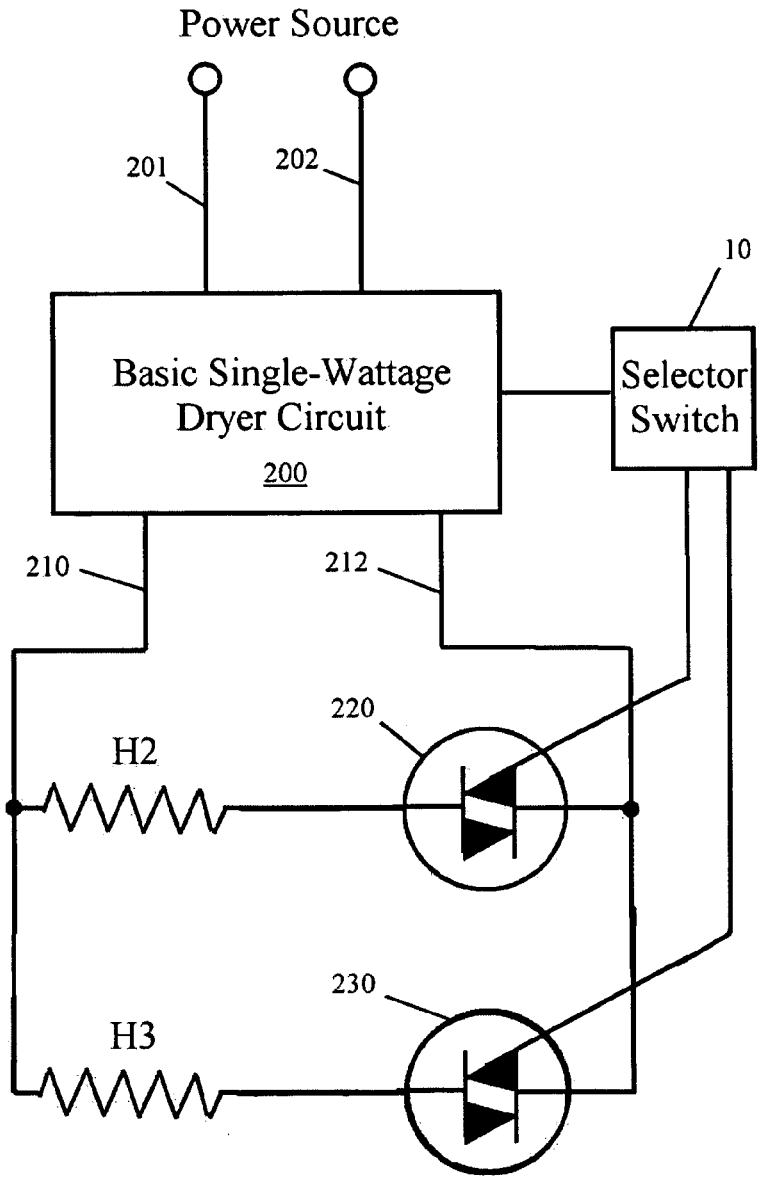
FIG. 3 is a circuit diagram of another embodiment of the invention.

Referring to FIG. 3, there is shown a solid-state version of the circuit of FIG. 2 wherein a pair of triacs 220, 230 are provided to turn the one or more supplementary heating elements H2, H3 on and off. The power selector switch 10 is therefore adapted to control these triacs rather than to control the additional heating elements directly.

Alternatively, rather than provide supplementary heating elements, it is possible to provide a single element and control the power supplied to the single element, such as by intermittently interfering with an AC signal or duty cycle. Intermittent interference is the method used by common household light dimmers, well known in the art.

Figure 4:
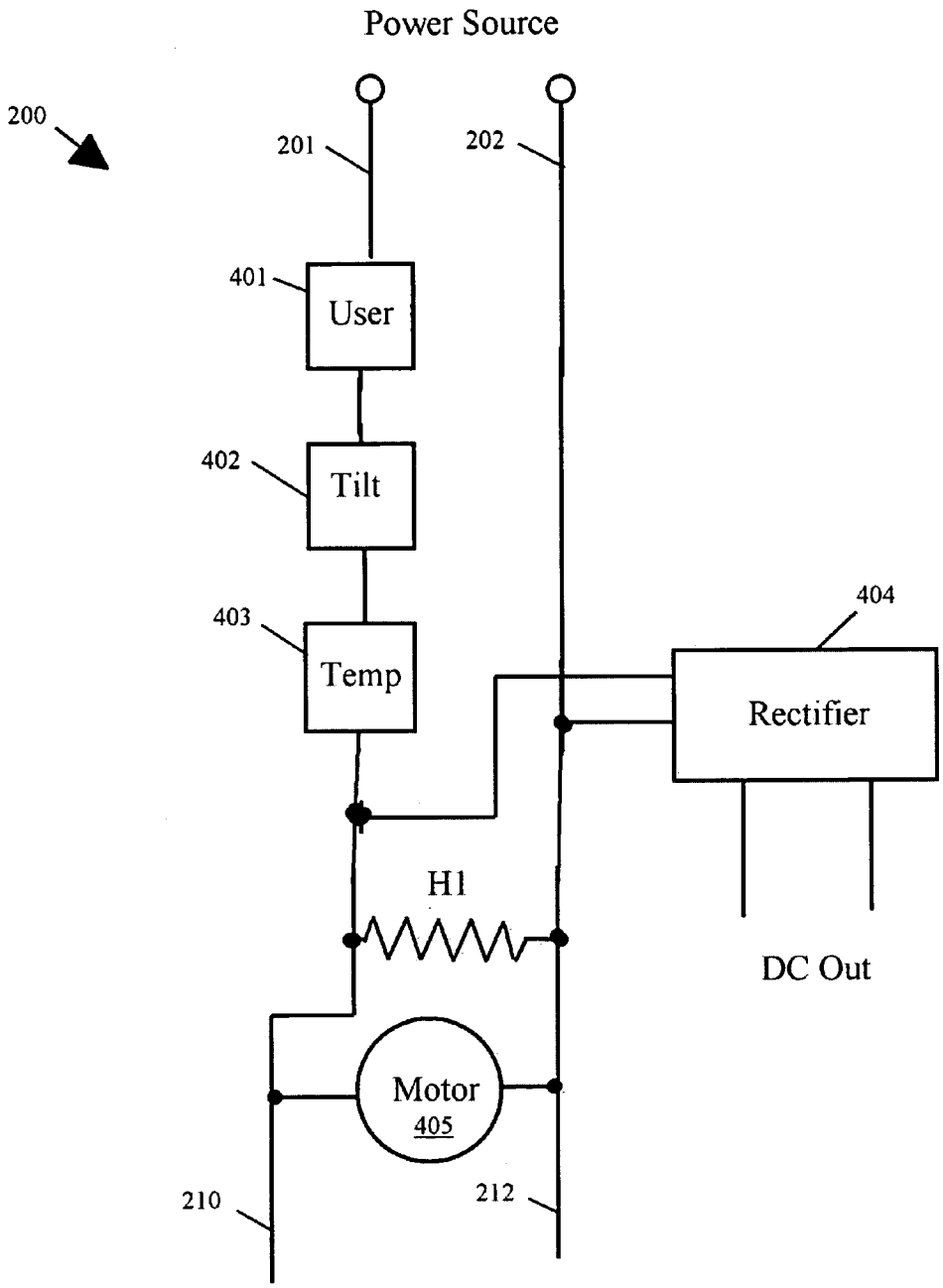
FIG. 4 is a schematic diagram of a basic single-wattage dryer circuit.

FIG. 4 shows a typical basic single-wattage hair dryer circuit wherein the power source may be connected to a rectifier 404 to provide a source of DC power for solid state components. The AC current is first controlled by user controls 401, namely the on/off trigger 5 of FIG. 1 and an optional limited power control 7 (see FIG. 1) that allows the user to alter the power output of the blow dryer up to the maximum power output permitted by the inaccessible power selector switch 10.

Figure 7:
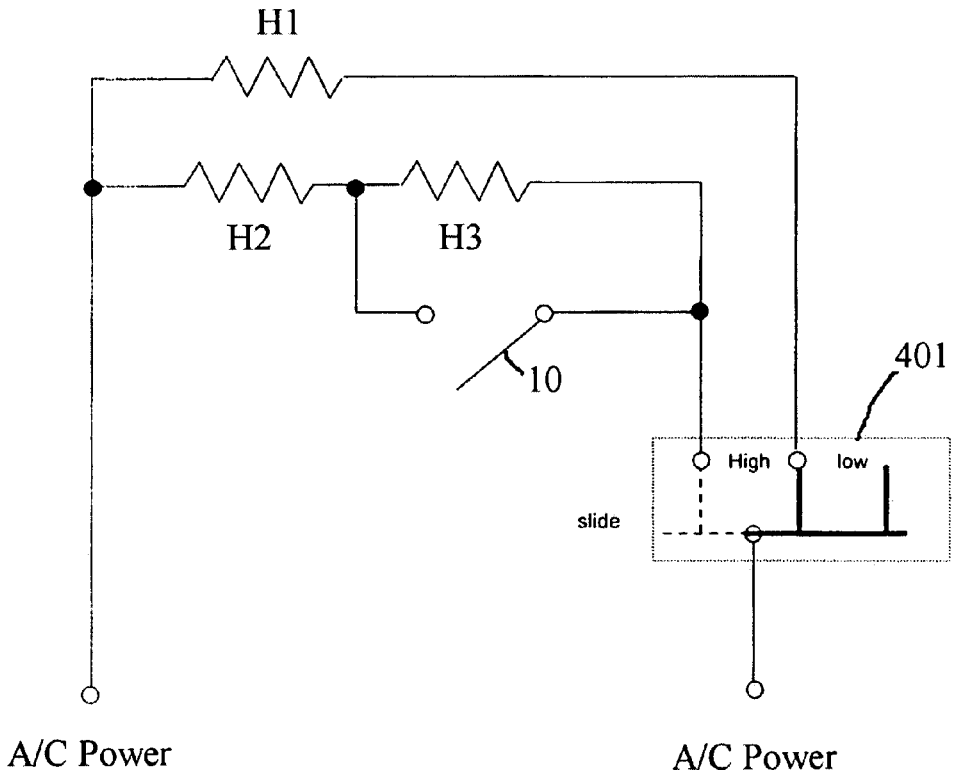
FIG. 7 is another low-cost embodiment of the invention.

Referring generally to FIGS. 1 and 7, the optional limited power control 7 is shown as a slide switch with four positions, but any other number of configurations are available as are known in the art, such as a continuous slide, a rotary switch or knob, and so forth. Because the user doesn't know what the actual maximum power is, this limited power control 7 will generally be marked with abstract marks 8 rather than actual numbers.

Also provided is an optional tilt switch 402, which can be a mercury switch that shuts off the dryer if dropped (such as into the bathtub) and a temperature switch 403, which can be a thermostat to shut off the heating elements if the temperature exceeds a preselected level so as to protect the blower components.

A blower motor 405 is also required. Here, the blower motor is also subject to the user controls 401, so that the blower runs at higher speeds for higher wattages if the optional power slide control 7 is used. Of course there are variants on these configurations. The motor could blow at the same speed at all power settings or, as is common with many blowers, the motor can have its own speed control.

Figure 5:
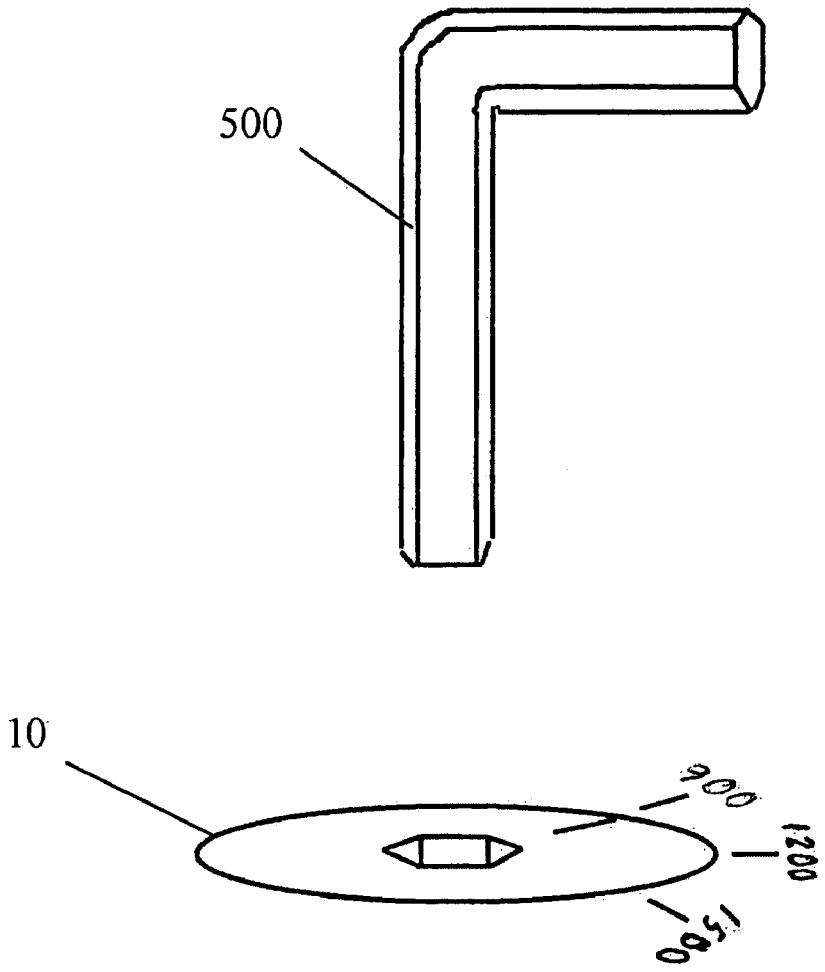
FIG. 5 is an embodiment of a hidden control switch and tool.

Referring to FIGS. 1 and 5, a typical power selector switch 10 is provided with three power settings and an optional tool 500 to work it. The power selector switch is substantially inaccessible and unusable to the user of the blower 1, but not inaccessible to an "administrator". An administrator will generally be an independent electrician or one of the maintenance staff of the hotel or other complex into which the blow dryers 1 are being installed. The location of the switch 10 will be made known to the administrator, such as hidden behind the intake port 4, allowing easy access by removing the intake port grating 4', or by access through some other hatch or opening. The power selector switch 10 may be operated by hand or by a specialized tool or key 500, preferably one of a type the user would not have with him. For example, an Allen wrench-type tool, i.e., hexagonal, or other unusually cross-sectioned tool, one the user could substitute a common item for, such as car keys, a nail file, or paper clip. Alternatively, one might resort to a standard key and lock.

Of course, the tool 500 is to be adapted to operate the switch 10. If the selector switch 10 is other than a rotary one as shown (e.g., a DIP switch) then, of course the tool must be altered to conform, but rotary switches may often be found to be easier and simpler to provide a key-like tool for.

Another advantage of a tool 500, is that it allows access to the power selector switch 10 without having to remove the intake grate 4 or other hatch. One could simply insert the tool through the grate or other opening to reach a properly positioned selector switch.

The embodiments shown represent "high-end" hair dryers. Simpler low-cost designs are also possible, such as shown in FIGS. 6 and 7.

Figure 6:
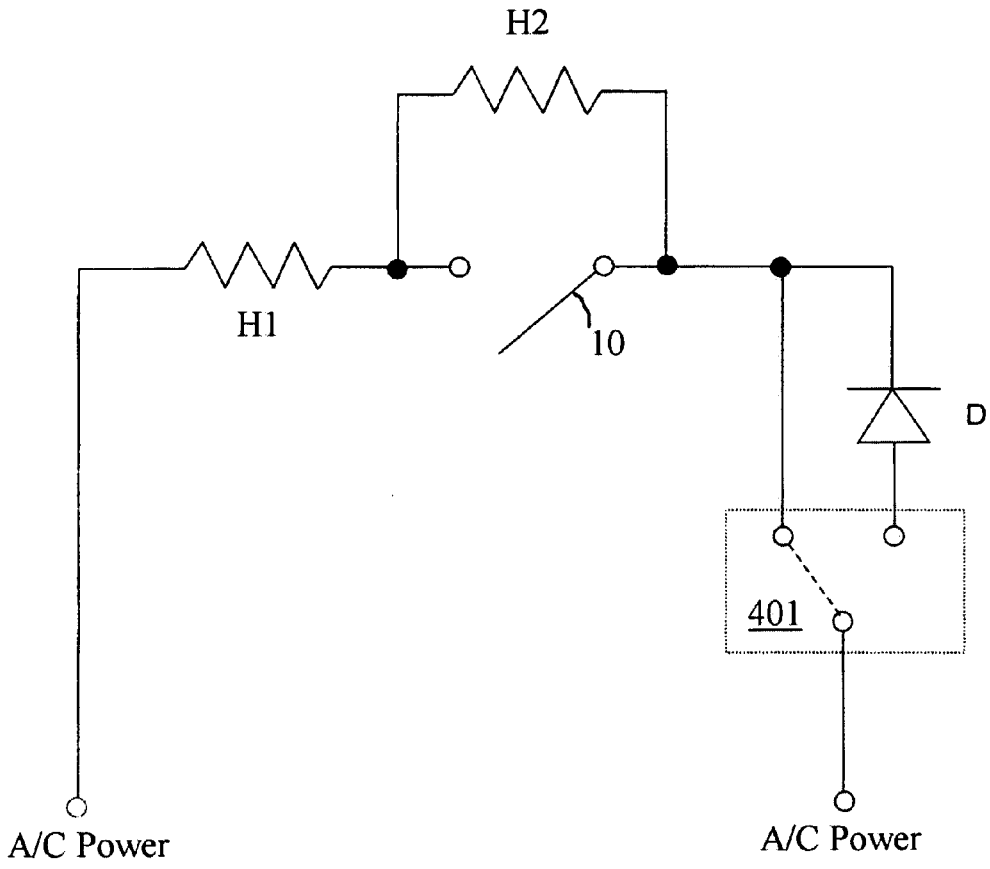
FIG. 6 is a low-cost embodiment of the invention.

Referring to FIG. 6, there are shown two heating elements H1, H2. When the hidden power selector switch 10 is open, both heating elements H1 and H2 are operating. In this embodiment, they are in series and therefore present greater resistance. The result is that both elements wired in series operate at a lower power. For example, H1 could be about 10 ohms and H2 about 3 ohms. With the switch open, such a circuit would operate at about 1,200 watts on house current. Close the power selector switch 10 and it operates at about 1,500 watts because the second heating element H2 is now shorted out and the overall resistance is lowered, thereby drawing more current.

A relatively inexpensive user control 401 is provided. It simply uses a diode D so that when the user activates the switch 401, current is diverted through the diode and is thereby rectifying the A/C current. Because the current is alternating current, only a half-wave may pass through the diode, thereby reducing the power by half.

Referring to FIG. 7, there is shown another low-cost circuit having three heating elements H1, H2, H3 and a user-controlled slide switch 401. Here, the first heating element H1 is always available to the user as a low power setting. For example H1 could be about 16 ohms and thereby provide a power output of about 500 watts or so, low enough to do without control switch 10 to limit its availability to the user. When the user switches to the higher setting, however, the same hidden power selector switch 10 and heater configuration as shown in FIG. 6 is provided.

Figure 8:
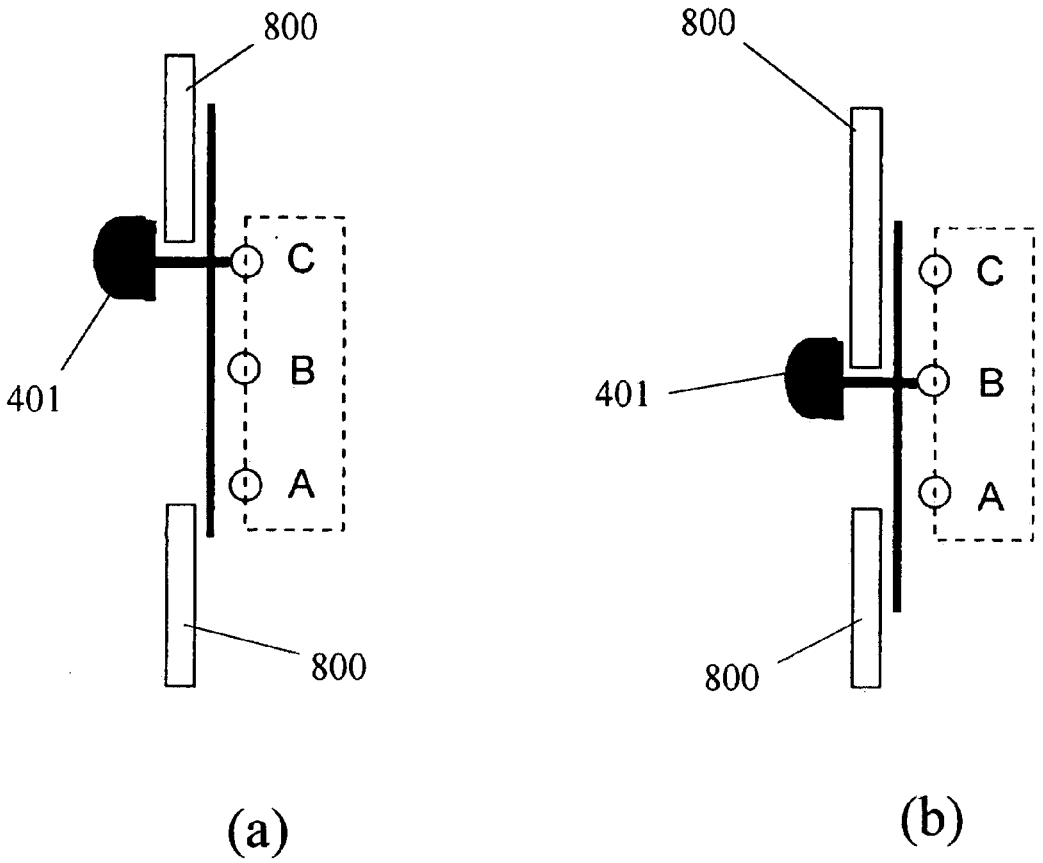
FIG. 8 shows another embodiment without a separate control switch.

Referring to FIG. 8, there is shown another embodiment that does now require a separate control switch at all. Here, a switch cover 800 is provided that defines an opening through which the user switch 401 protrudes. If the opening is wide enough, as in FIG. 8*a*, the user has all power settings available to him. Alternatively, as in FIG. 8*b*, a switch cover 800 with a smaller opening may be provided that limits the power settings available to the user. In a preferred embodiment, the switch cover conceals the existence of the inaccessible power settings.

While various values, scalar and otherwise, may be disclosed herein, it is to be understood that these are not exact values, but rather to be interpreted as "about" such values, unless explicitly stated otherwise. Further, the use of a modifier such as "about" or "approximately" in this specification with respect to any value is not to imply that the absence of such a modifier with respect to another value indicated the latter to be exact.

Changes and modifications can be made by those skilled in the art to the embodiments as disclosed herein and such examples, illustrations, and theories are for explanatory purposes and are not intended to limit the scope of the claims. Further, the abstract of this disclosure is provided for the sole purpose of complying with the rules requiring an abstract so as to allow a searcher or other reader to quickly ascertain the subject matter of the disclosures contained herein and is submitted with the express understanding that it will not be used to interpret or to limit the scope or the meaning of the claims.

What is claimed is:

1. A hair dryer, comprising:

a casing;

an electric blower adapted to draw air into the casing from an intake port and blow the air out an exhaust port;

one or more electric hair dryer heating elements disposed to heat the air as it passes through the casing;

a power selector switch having two or more wattage settings, each wattage setting adapted to supply electrical power to the hair dryer heating elements; and wherein said power selector switch is inaccessible to the user.

2. The hair dryer of claim 1 wherein the switching of the selector switch requires a tool.

3. The hair dryer of claim 1 wherein the power selector switch is concealed from the user's view during normal operation of the hair dryer.

4. The hair dryer of claim 1 wherein the power selector switch is adapted to short out one or more of the heating elements.

5. The hair dryer of claim 1 wherein the power selector switch is adapted to divert current amongst the heating elements.

6. The hair dryer of claim 1 further comprising a user control allowing the user to adjust the power output of the heating elements up to a maximum determined by the setting of the power selector switch.

7. The hair dryer of claim 6 wherein the user control allows the user to divert alternating current through a diode.

8. A hair dryer, comprising:

a casing;

electric blower means for drawing air into the casing from an intake port and blowing the air out an exhaust port;

one or more electric hair dryer heating means for heating the air as it passes through the casing;

power selector switching means having two or more wattage settings adapted to supply electrical power to the hair dryer heating elements; and wherein said power selector switching means is hidden from a user.

9. A hair dryer, comprising:

a casing;

electric blower means for drawing air into the casing from an intake port and blowing the air out an exhaust port;

one or more electric hair dryer heating means for heating the air as it passes through the casing;

user switching means having two or more wattage settings adapted to supply electrical power to the hair dryer heating elements; and a switch cover means for optionally limiting the wattage setting available to the user.

* * * * *